US005638561A

United States Patent [19]

Sperry et al.

[11] Patent Number: 5,638,561

[45] Date of Patent: Jun. 17, 1997

[54] COMBINATION INFANT BLANKET AND TOY WITH CONVERTIBLE BAG

[76] Inventors: Rosemarie Patricia Sperry; William John Sperry, Jr., both of 1585 Golf Course Rd., Whiteville, N.C. 28472

[21] Appl. No.: 581,945

[22] Filed: Jan. 2, 1996

[51] Int. Cl.[6] ..... A47G 9/02

[52] U.S. Cl. ..... 5/485; 5/907; 446/72

[58] Field of Search ..... 5/917, 485, 482, 5/907; 383/4, 22, 24; 446/72, 73, 74

[56] References Cited

U.S. PATENT DOCUMENTS

| | | | |
|---|---|---|---|
| D. 91,135 | 12/1933 | Gilliyan | 12/193.3 |
| D. 152,173 | 12/1948 | Seidler | 383/24 X |
| D. 300,784 | 4/1989 | Powers et al. | D3/42 |
| D. 316,791 | 5/1991 | Canney et al. | D6/595 |
| D. 330,990 | 11/1992 | Barnes | D6/603 |
| 2,129,654 | 9/1938 | Dennis | 383/22 X |
| 2,227,751 | 1/1941 | Adelman | 2/84 |
| 3,197,100 | 7/1965 | Thompson | 224/6 |
| 4,125,903 | 11/1978 | Farrell | 5/485 X |
| 4,254,900 | 3/1981 | Wheeler | 224/158 |
| 4,590,633 | 5/1986 | Pickens | 5/485 X |
| 4,889,512 | 12/1989 | Burnett et al. | 446/72 |
| 4,993,090 | 2/1991 | Ranalli | 5/482 |
| 5,243,724 | 9/1993 | Barnes | 5/482 |

*Primary Examiner*—Michael F. Trettel
*Attorney, Agent, or Firm*—John D. Gugliotta; David I. Volk

[57] ABSTRACT

A combination infant blanket and toy is disclosed consisting of the following machine washable, flame-retardant components: a doll head with a pleasant face, fabric cut-out for "curly" hair and a fabric loop at the top which can be used to hang it on a wall or bed post. A diamond-shaped top-opening fabric bag forms the body.

6 Claims, 2 Drawing Sheets

COMBINATION INFANT BLANKET AND TOY WITH CONVERTIBLE BAG

BACKGROUND OF THE INVENTION

1. Field of the Invention

The present invention relates generally to infant blankets and, more particularly, to an infant blanket and integral toy with a convertible bag.

2. Description of the Related Art

In the related art, many devices functioning as infant blankets are known. For example, in U.S. Pat. No. 5,243,724, issued in the name of Barnes, a multipurpose baby wrap is disclosed which converts to a blanket, a bunting, a pad, or a carrier sling.

Also, in U.S. Pat. No. 4,993,090, issued in the name of Ranalii, a baby blanket for use in a car seat is disclosed which accommodates the restraining harness of an infant car seat.

And again, in U.S. Pat. No. 4,254,900, issued in the name of Wheeler, a baby lift carrier and pad assembly is disclosed providing a structure to allow lifting or transporting of a baby or infant in a convenient manner.

Also, in U.S. Pat. No. 2,227,751, issued in the name of Idelman, a combination infant's garment and blanket is disclosed.

And additionally, many ornamental designs are known for baby blankets and convertible baby blankets, including Design U.S. Pat. No. 330,990, issued in the name of Barnes, Design U.S. Pat. No. 316,791, issued in the name of Carney et al., and Design U.S. Pat. No. 300,784, issued in the name of Powers et al.

Although these numerous references disclose such various configurations, none provide an apparatus which includes a blanket formed of a diamond-shaped top-opening fabric bag having a doll head with a pleasant face at the top.

SUMMARY OF THE INVENTION

It is therefore an object of the present invention to provide an improved infant play-toy.

It is another object of the present invention to provide and improved infant play-toy which can be utilized as a blanket.

It is a feature of the present invention to provide an improved infant play-toy and blanket combination which forms a doll whose body is a diamond-shaped top-opening fabric bag.

Briefly described according to one embodiment of the present invention, a combination infant blanket and toy is disclosed consisting of the following machine washable, flame-retardant components: a doll head with a pleasant face, a fabric cut-out for "curly" hair and a fabric loop at the top which can be used to hang it on a wall or bed post. A diamond-shaped top-opening fabric bag forms the body.

Some advantages of the present invention are made obvious by the many interesting ways in which it can be utilized. A child user can hug it like a doll or security blanket and truly enjoy putting toys inside the bag and then taking them out again. Further, for infant caretakers, it can be used to lay the baby on top for changing diapers, carrying accessories, storing pajamas on top of the bed and, of course, as a warm blanket for home or travel.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
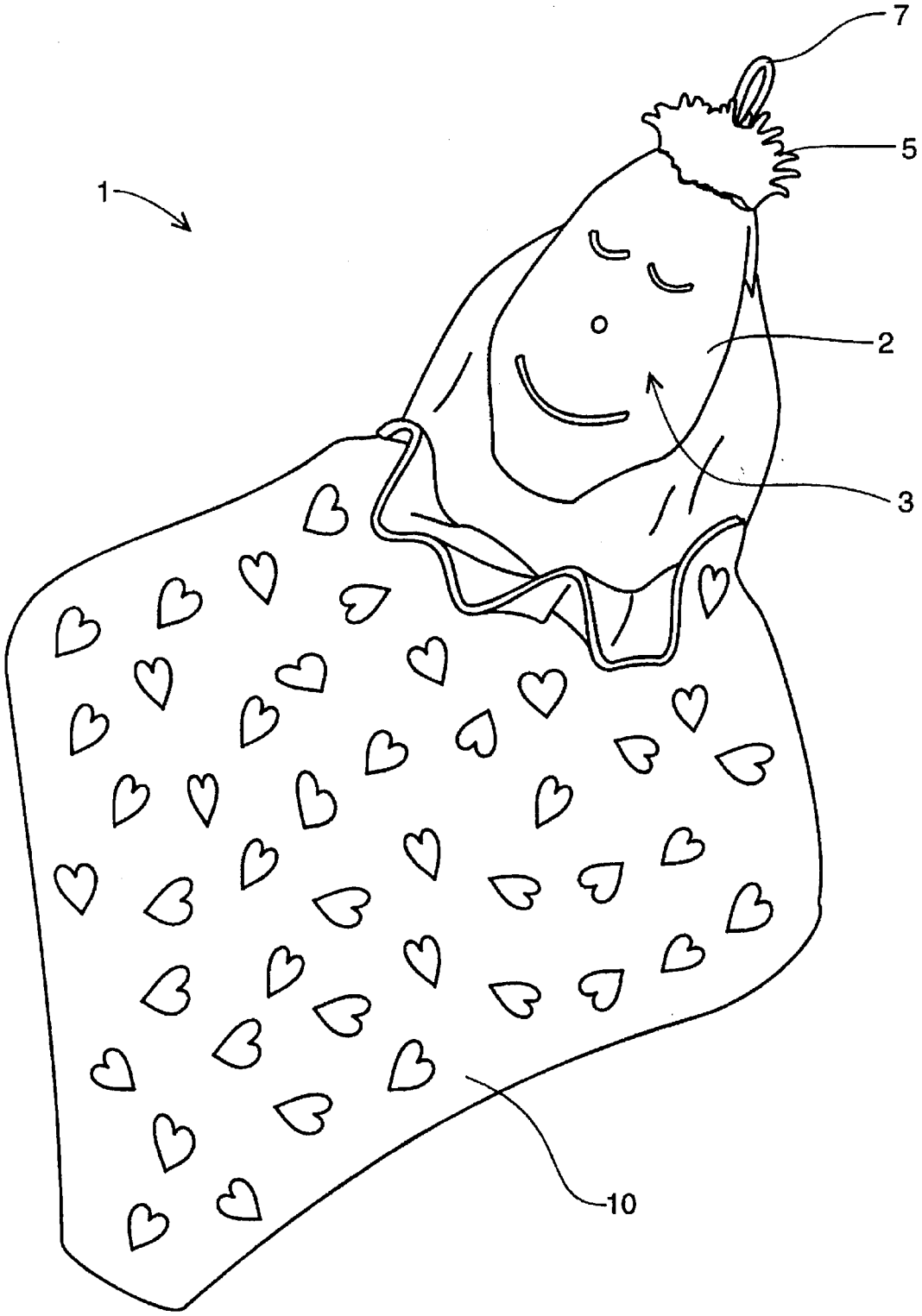
FIG. 1 is a front perspective view of a combination infant toy and blanket according to the preferred embodiment of the present invention.
Figure 2:
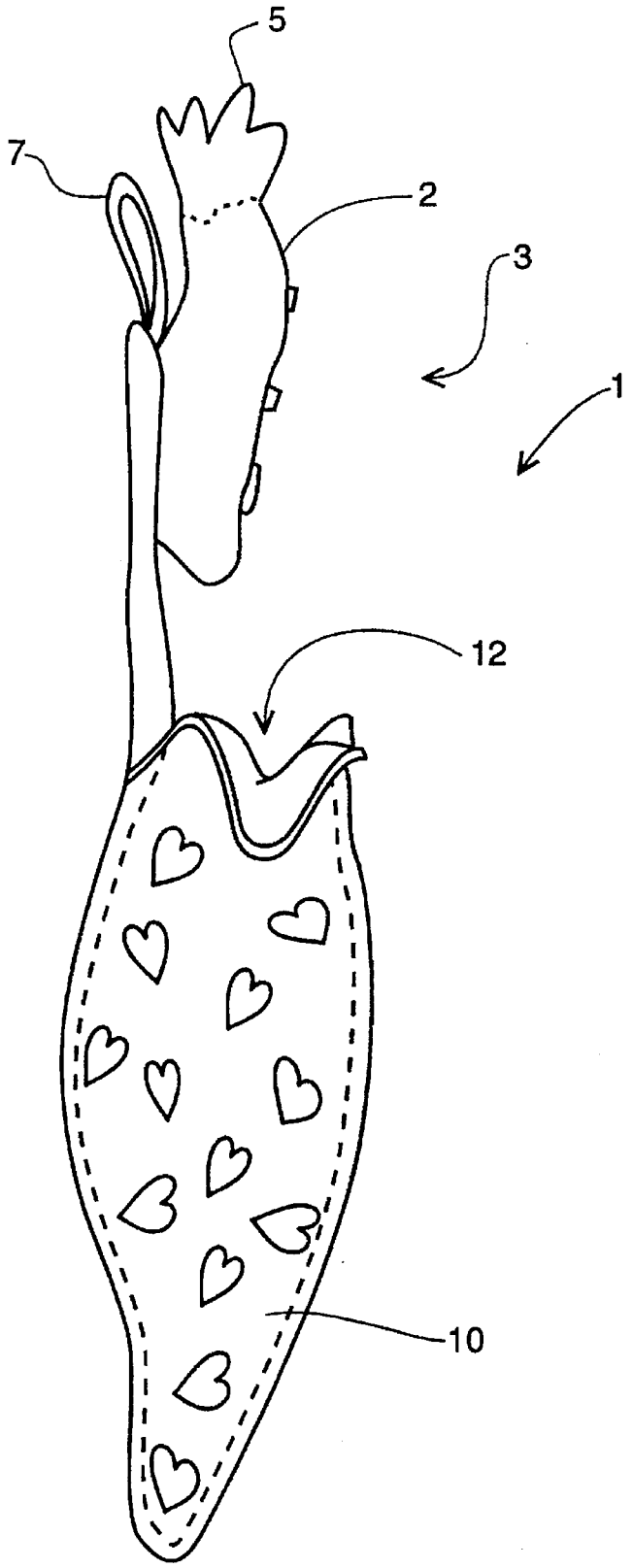
FIG. 2 is a side view thereof.

Referring now to FIG. 1 and FIG. 2, a combination infant toy and blanket 1 is shown, according to the present invention, comprising a sewn fabric item which can serve as a blanket, a doll, an educational toy, a storage device and a wall hanging.

The infant toy and blanket 1 consists of the following machine washable, flame-retardant components: a doll head 2 with a pleasant face 3, fabric cut-out 5 for depicting "curly" hair atop the head 2, and a fabric loop 7 at the top which can be used to hang it on a wall or bed post. A diamond-shaped top-opening fabric bag 10 forms the body of the doll, and also comprises the blanket portion. As shown best in FIG. 2, a cavity 12 is formed by and contained within the bag 10. It is currently envisioned that the fabric bag 10, in its preferred embodiment, be of a size no bigger than that which would cover a baby in a child car seat or stroller. However, it is also presently envisioned that various sizes can also be provided.

2. Operation of the Preferred Embodiment

In operation, the present invention can be utilized by children or adults in many interesting ways. Used by a child as a play-toy, it can be hugged like a doll or security blanket, or a hiding toy by putting toys inside the bag and then taking them out again. Used by a parent or other care giver, the present invention can be used to lay the baby on top for changing diapers, carrying accessories, storing pajamas on top of the bed and, of course, as a warm blanket for home or travel.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A combination infant blanket and toy comprising:

a. a bag having a front portion and a rear portion, the rear portion having an extended portion which extends beyond the front portion, the bag forming a doll body and the extended portion forming a doll neck;

b. a doll head attached to the extended portion, the doll head facing the front portion;

c. structure forming an opening into the bag, the opening positioned between the front and rear portions, beneath the doll head, and adjacent the extended portion, the opening having an edge which forms a doll collar; and d. a loop on the bag which can be used to hang the combination on a wall or bed post.

2. The combination infant blanket and toy as described in claim 1, wherein the head, the bag, and the loop are each comprised of machine washable, flame-retardant, sewn fabric material.

3. The combination infant blanket and toy as described in claim 1, wherein the bag is a diamond shape.

4. A combination infant blanket and toy comprising:

a. a bag having a front portion and a rear portion, the rear portion having an extended portion which extends beyond the front portion;

b. the bag forming a doll body;

c. the extended portion forming a doll neck and a doll head facing the front portion;

d. structure forming an opening into the bag, the opening positioned between the front and rear portions and adjacent the extended portion, the opening having an edge which forms a doll collar; and e. a loop on the bag which can be used to hang the combination on a wall or bed post.

5. The combination infant blanket and toy as described in claim 4, wherein the head, the bag, and the loop are each comprised of machine washable, flame-retardant, sewn fabric material.

6. The combination infant blanket and toy as described in claim 4, wherein the bag is a diamond shape.

* * * * *